US006138905A

United States Patent [19]

Hachenski

[11] Patent Number: 6,138,905

[45] Date of Patent: Oct. 31, 2000

[54] MEAL KIT WITH IMPROVED GRAPHICS DISPLAY

[75] Inventor: Shelley Hachenski, Chicago, Ill.

[73] Assignee: Kraft Foods, Inc., Northfield, Ill.

[21] Appl. No.: 09/454,111

[22] Filed: Dec. 3, 1999

[51] Int. Cl.[7] ..... B65D 5/54

[52] U.S. Cl. ..... 229/207; 206/459.5; 229/243; 229/902

[58] Field of Search ..... 229/207, 221, 229/243, 902; 206/45.28, 45.29, 459.5; 426/122, 123

[56] References Cited

U.S. PATENT DOCUMENTS

| | | | |
|---|---|---|---|
| 3,080,238 | 3/1963 | Kraft et al. | 426/123 |
| 3,423,005 | 1/1969 | Leibson et al. | 426/123 |
| 3,735,914 | 5/1973 | Collura et al. | 229/207 |
| 4,344,533 | 8/1982 | Olsen | 206/459.5 |
| 5,358,171 | 10/1994 | Focke | 229/243 |
| 5,641,062 | 6/1997 | Burton et al. | 206/459.5 |
| 5,680,986 | 10/1997 | Botterman | 229/207 |
| 5,769,226 | 8/1998 | Harris | 229/243 |
| 6,003,664 | 12/1999 | Dolan | 206/45.29 |

*Primary Examiner*—Gary E. Elkins

*Attorney, Agent, or Firm*—Fitch, Even, Tabin & Flannery

[57] ABSTRACT

The invention provides a food packaging system for a meal kit that includes a novel outer carton with a moveable cover that provides a high impact display when opened. The cover includes a breakaway panel that is initially a part of the front wall, and provides a large printable area on its interior surface for communication with the customer, providing a billboard effect when the cover is opened. The opened packaging system also permits the viewing of one or more separate disposable single-use pouches containing one or more of the food components. In one embodiment, the front wall of the carton has a button formed therein immediately beneath the flap, or front portion of the cover. The button is inwardly displaceable so that a user may, by applying pressure to said button, insert a digit beneath a lower end of the flap and pull the lower end and outward, then progressively remove the flap from the front wall to provide visual and manual access to the meal component pouches through the front wall. In the preferred embodiment, the top wall comprises first and second top flaps of the front and back wall respectively, the first and second top flaps being joined to one another and being integral with the front and back wall respectively, but not joined to the side walls. The lines of weakness preferably comprise downwardly convergent rev cuts configured to facilitate outward displacement of said flap.

9 Claims, 3 Drawing Sheets

MEAL KIT WITH IMPROVED GRAPHICS DISPLAY

BACKGROUND OF THE INVENTION

1. Field of the Invention

The invention relates generally to food products, and more particularly to a meal kit and associated packaging therefor.

2. Background and Description of Related Art

The prior art includes meal kits in which a plurality of pre-measured meal components are packaged together for consumer use in preparation of a meal. Some meal kits include a plurality of pouches containing different meal components that are to be combined with, e.g., water, milk, butter, margarine, salt and/or other commonly available ingredients, with instructions for preparation of the meal included on the package. The steps required for preparation of the meal may include, e.g., one or more steps involving mixing or otherwise combining various components, and one or more cooking steps.

In providing packaging for this type of product, among the considerations that must be addressed are the ability of the packaging to receive product in high-speed commercial filling operations; the degree of difficulty that will be encountered by the consumer in opening the packaging and dispensing or removing product; the ability of the packaging to withstand various loads, such as stacking loads, during filling, sealing, shipping, display, and consumer use; the ability of the packaging to be interfit efficiently among like packaging; the cost of manufacture.

It is also important that packaging of this type be aesthetically pleasing where it is intended to be displayed for commercial sale to consumers in grocery stores and/or other retail establishments. The graphics that are visible at a retail location generally must include required notices such as ingredient information, and the space available for graphics on the package exterior is limited.

One of the problems addressed by the invention is to provide improved economical, commercially viable packaging for meal kits which adequately addresses the above considerations.

Another problem addressed herein is to provide such packaging with improved graphics display capability.

A further problem addressed herein is facilitation of opening of such packaging without making the carton unacceptably susceptible to damage or failure during shipping and handling.

SUMMARY OF THE INVENTION

The invention provides a food packaging system for a meal kit that includes a novel outer carton with a movable cover that provides a high impact graphic display when opened. The cover includes a breakaway panel that is initially a part of the front wall, and provides a large printable area on its interior surface for communication with the customer, providing a billboard effect when the cover is opened. The carton preferably has sufficient strength and stiffness to withstand compression loads experienced during packaging, shipping, handling, retail display and consumer use. The packaging system provides tamper-evident protection for the meal kit components while also making them readily accessible to the consumer, without requiring direct manual contact with the food components. The packaging system may include one or more separate hermetically sealed disposable single-use pouches containing one or more of the food components.

The carton is described herein with reference to a front wall and a back wall. These terms are used primarily for purposes of distinguishing the two walls, and are not intended to be limiting. It is anticipated that, in normal use by the consumer, the front wall will face the consumer while the consumer is preparing a meal. However, during in-store display for purchase, the back wall may be oriented to face the purchaser, and may be provided with graphics appropriate for this purpose.

The meal kit may include a disposable carton and one or more recipe components in the carton, wherein the carton is openable at the front wall, utilizing lines of weakness provided in any fashion, including reverse cuts, or "rev cuts", and/or perforations, to tear open the carton through the front wall and flip back the top wall after the front wall is torn. Thus, the cover, comprising the breakaway front panel and the top wall, is hingedly attached to the back wall of the carton. The carton, when opened, reveals the recipe components contained therein, which comprise a kit for preparing a meal. The recipe components of the kit are visually accessible through the opening created in the front wall by tearing open the carton, and the front wall opening may also facilitate manual removal of the components from the carton. In addition, the interior surface of the removable front wall and top wall is also in view of the consumer once the cover is fully opened, and provides a billboard space for viewing illustrations or writing contained thereon. The cover may stay open throughout preparation of the meal, with the billboard space, as well as the recipe components, prominently displayed in view of the consumer throughout the process of preparing the meal.

The breakaway flap may be defined by three borders on the front wall, wherein the first and second borders proceed diagonally toward one another from respective top corners of the front wall, and the third border defines the region where the first border and the second border come in proximity to one another, wherein the third border is approximately parallel to the top edge of the front wall.

The meal kit is designed so that the interior surface of the cover displays illustrations or writing which are visible to the consumer only after the carton is opened. The meal kit is also designed so that the cover is capable of supporting itself in an open position, so that the interior surface of the cover remains exposed and visible to the consumer and the contents remain easily accessible, without interference from the cover, during preparation of a meal using those recipe components. The vertical dimension of the front wall portion of the cover is preferably substantially greater than the depth of the carton to provide the front wall portion with a significant visual impact when the cover is in its open position. The meal kit is preferably made so that the top side flaps hingedly attached to the side walls are less than about ⅙ to about ⅛ the width of the carton.

The front wall of the carton preferably has a button formed therein immediately beneath the flap, the button being inwardly displaceable so that a user may, by applying pressure to the button, insert a digit beneath a lower end of the flap, then pull the lower end outward, then progressively remove the flap from the front wall to provide visual and manual access to the meal component pouches through the front wall. In the preferred embodiment, the top wall comprises first and second top flaps of the front and back wall respectively, the first and second top flaps being joined to one another and being integral with the front and back wall respectively, but not joined to the side walls. The lines of weakness preferably comprise downwardly convergent rev cuts configured to facilitate outward displacement of said flap. In the illustrated embodiment, the button is initially joined to adjacent portions of the front wall, such as the bottom of the flap, by a frangible connection which may be fractured by application of pressure by a user's thumb or finger.

DETAILED DESCRIPTION OF THE PREFERRED EMBODIMENTS

Figure 1:
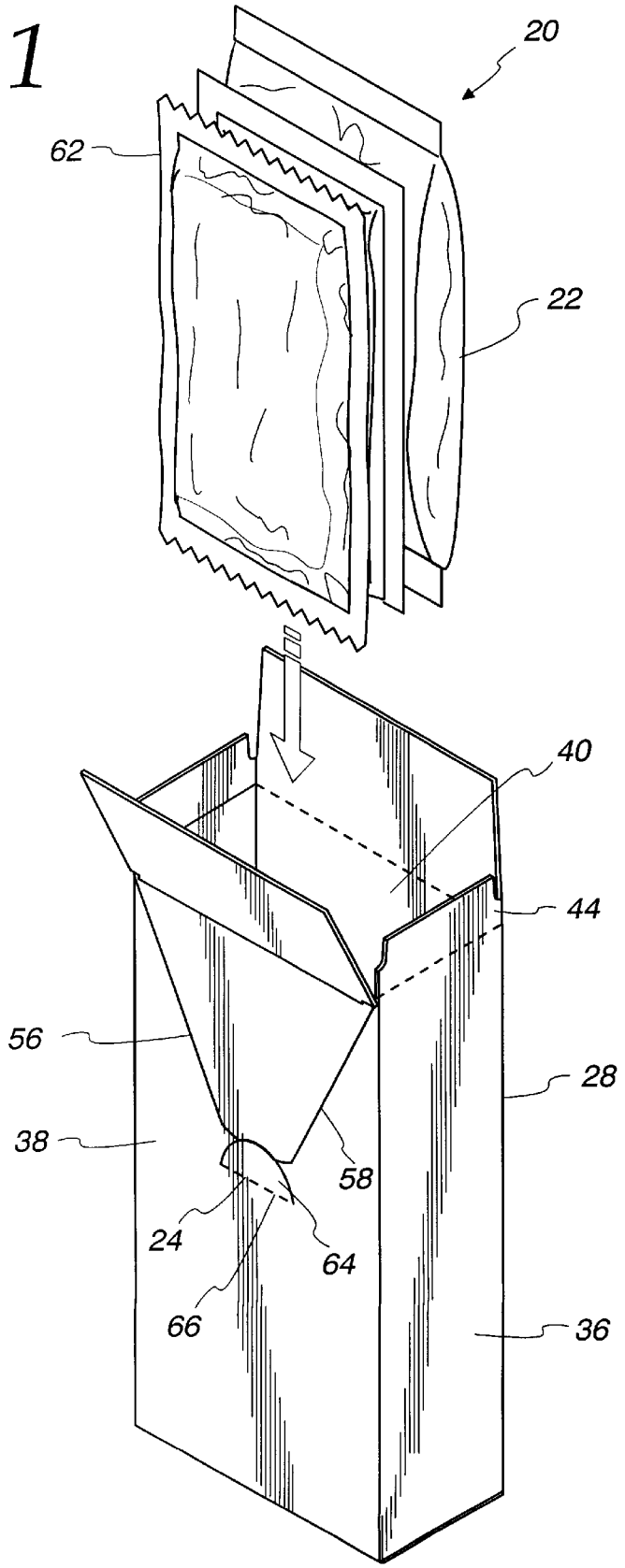
FIG. 1 is a perspective view of a meal kit in accordance with a preferred embodiment of the invention depicting the loading of the carton.
Figure 2:
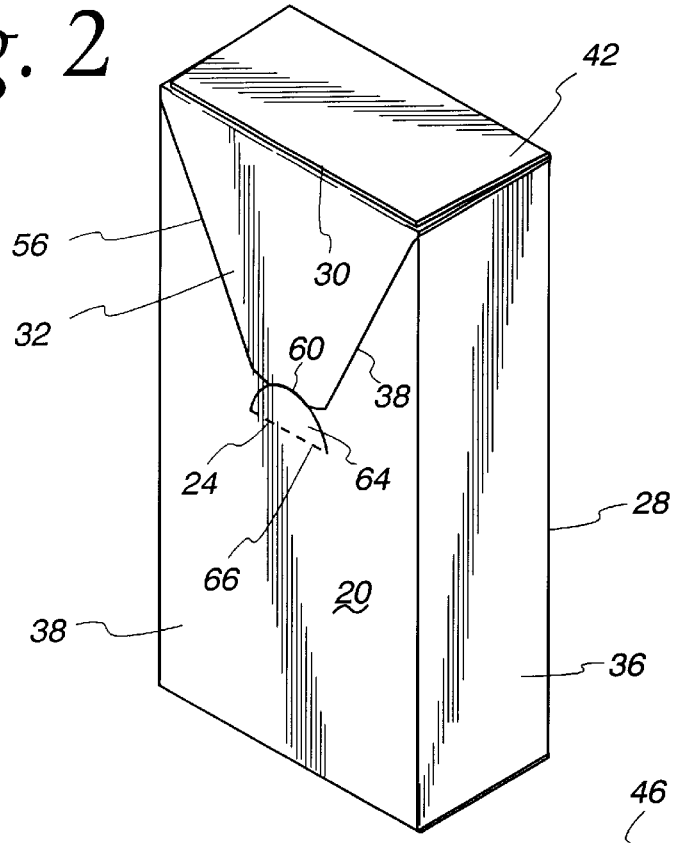
FIG. 2 is a perspective view of the meal kit of FIG. 1 after loading and sealing of the carton.

The invention is preferably embodied in a meal kit and associated packaging therefor as shown in FIGS. 1–6. In the illustrated embodiments, the meal kit and associated packaging 20 system is used in conjunction with packets 22 of food for preparation of a meal. The easy-open feature 24 of the packaging permits the ready access to the interior of the associated packaging system 20. The associated packaging 20, once opened, reveals the contents of the meal kit 20 and the billboard 26 of graphics set forth on the interior surface of the carton 28 of the meal kit 20.

For the purpose of illustrating the meal kit and associated packaging 20, there are shown in the drawings, which form a material part of this disclosure, preferred embodiments of the invention. The various components of the meal kit 20 of the present invention may be generally arranged as shown in the drawings, or as described herein below. The arrangements, configurations dimensions and instrumentalities may be otherwise, as circumstances require.

A preferred embodiment of the meal kit and associated packaging will now be described with reference to the drawings. In the drawings, like reference symbols indicate the same components throughout the different views.

FIGS. 1–6 show a meal kit with associated packaging 20 in accordance with a first embodiment of the invention and its method of use. The meal kit of FIGS. 1–6 generally includes a novel outer carton 28 with a movable cover 30 and one or more recipe components 22 within the carton.

The carton 28 comprises a container for a plurality of recipe components 22 comprising a meal kit 20. The carton 28 defines an enclosed interior space for the recipe components. The carton includes a bottom wall, two side walls, a front wall, a back wall and a cover hingedly connected to the back wall.

The carton 28 may be made of paperboard of any suitable thickness. For example, paperboard having a thickness of about 0.01 to about 0.025 in. may be used, and in one particular embodiment, paperboard having a thickness of about 0.015 to about 0.022 in. is employed.

The dimensions of the kit are preferably selected, in conjunction with the weight and dimensions of the meal components, to enable the carton 28 to stand upright in a stable position during preparation of a meal. The height of the carton may range from about 4.5 to about 9.5 in. and is preferably about 7.0 in. The width of the carton may range from about 3.5 to about 6.5 in., and is preferably about 4.75 in. The depth of the carton may range from about 1.0 to about 4.0 in., and is preferably about 2.25 in.

The carton 28 includes a breakaway panel 32 that is initially a part of the front wall. The carton preferably has sufficient strength and stiffness to withstand compression loads experienced during packaging, shipping, handling, retail display and consumer use. The packaging system provides tamper-evident protection for the meal kit components. This tamper-evident protection is provided by the perforated seal where the breakaway of the front wall is initiated, and any type of tamper evident cut, such as perforations or reverse cuts, along the lines wherein the front wall is torn to provide the openable cover of the carton. Moreover, all the glued flaps are tamper-evident. For purposes of this application, the term "line" used in association with the demarcations where the tear of the front wall take place is not intended to include only straight single lines, but also includes reverse cuts, double perforations, curves or angled configurations and any other shape that is appropriate for the demarcation of regions wherein tears in the carton are desired.

In the illustrated embodiment of FIGS. 1–5, the carton 28 comprises a generally flat-sided container, including a generally rectangular bottom wall 34, a pair of generally rectangular side walls 36, a generally rectangular front wall 38, a generally rectangular back wall 40, and a generally rectangular top wall 42. The carton is manufactured as a sleeve, wherein the front wall, a side wall and the back wall are contiguous and separated merely by folds, and one side wall includes two flaps that are glued to one another, thereby completing the sleeve by generating the fourth wall. The top wall 42 is generated when two side flaps 44 hingedly attached to each of the top ends of the side walls are folded inward, and the respective two top flaps 44 hingedly attached to the front wall 38 and back wall 40 are folded inward and glued in place. Likewise, the bottom wall 34 is generated when two side flaps hingedly attached to each of the bottom ends of the side walls are folded inward, and the respective two bottom flaps hingedly attached to the front wall and back wall are folded inward and glued in place.

The portion of the front wall 32 bordered by the lines facilitating tearing of the front wall and the top wall comprise the movable cover of the carton. The vertical measurement of the height of the front wall that is torn away is preferably greater than the depth of the carton, thereby giving rise to a larger vertical height of the front wall portion 32 of the cover than the top wall portion 46 of the cover once the cover is opened as stays open. This embodiment permits the inclusion of illustration or writing which is greater in amount than that included on the interior surface of the top wall. In some embodiments, this may be preferable.

The carton 28 is disposable, and the kit will preferably be used for the preparation of a single meal. The carton is openable at the front wall, utilizing lines of weakness, which may be provided in any fashion, including reverse cuts, score lines and/or one or more lines of perforation. Such lines of weakness permit the consumer to open the carton along the cover borders of the front wall and fold back the cover after the front panel 32 is broken away. Thus the cover 30, comprising the torn front panel 32 and the top wall 46, is hingedly attached to the back wall of the carton.

The carton 28 in the preferred embodiments is made of a paperboard substrate, but in other embodiments might be made of other materials, or combinations of paperboard, plastics, and/or other materials.

Figure 6:
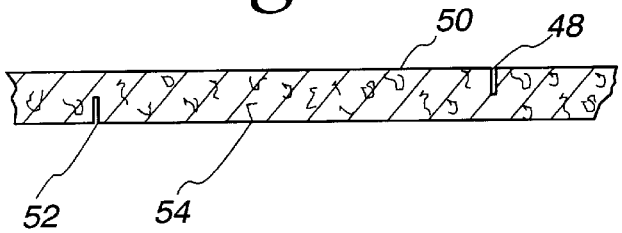
FIG. 6 is a sectional view of the reverse cuts used in the carton of FIG. 1.

The breakaway panel 32 in the illustrated embodiment is defined by three borders on the front wall. The borders are lines of weakness which may be, as discussed above, the reverse cuts, that permit the consumer to cleanly tear the front wall. The cut lines penetrate only a part of the distance through the front wall, preferably from about 40% to about 50% of the panel thickness. In this manner of demarking the borders of the front wall panel of the cover, a first cut line 48 extends partially through the inner surface 50 of the paperboard, as shown in FIG. 6. The first cut line 48 preferably extends to a depth of approximately 40% to about 50% of the thickness of the paperboard. A second cut line 52 is formed in the outer surface 54 of the paperboard as shown in FIG. 6. The depth of the second cut line 52 is preferably about 40% to about 50% of the thickness of the paperboard. The reverse cuts are generated using two parallel cut lines within a predetermined distance from one another, to form a frangible area between the first cut line 48 and the second cut line 52. This distance is approximately 0.25 inches and this offset is approximately uniform along the first cut line and the second cut line. The frangible area allows the opening formed at the third border to separate the front wall portion of the carton cover from the portion of the front wall that remains in place when the carton is torn open along the first and second borders.

The first 56 and second 58 borders of the front portion of the cover may be downwardly convergent or may be parallel to one another, and each intersects the third 60 border which may be generally parallel to the top edge of the front wall. Tearing of the front wall is initiated, preferably, by tearing the third border 60 until the tear propagates to the first 56 and second 58 borders. In the illustrated embodiment, wherein the first and second borders proceed diagonally toward one another from respective top corners of the front wall, the third border 60 defines a region where the first and the second border are in close proximity to one another, as depicted in FIGS. 1–4. In this embodiment, the third border is generally parallel to the top edge of the front wall, but is curved upward between its ends with a radius of curvature that is preferably between about ½ in. and 1 in., and may be, e.g., about ¾ in.

The recipe components 22 are preferably enclosed in flexible envelopes 62 or packets. Each of the envelopes 62 or packets may be formed from one or more webs of material, and may be sealed around some or all edges, or may include a longitudinal fin seal and transverse end seals. In the preferred embodiments, the envelope or packet is hermetic, and may contain a gas flushed or vacuum sealed environment. In other embodiments, for selected products, a cold seal pouch material could be used rather than a hermetically-sealable material, and the envelopes may be formed with cold seals, and may be non-hermetic.

The envelopes 62 may include weakened areas to facilitate opening. The weakened area may comprise, e.g., a notch, slit, or series of scratches or the like in one or more layers of laminated film.

The envelopes 62 are preferably made of a flexible plastic film or metal film, which may comprise, e.g., one or more layers of polyethylene, polypropylene, nylon, polyethylene terephthalate (PET), linear low density polyethylene (LLDPE), or other polymeric materials, and/or metal foil, paper, or other suitable materials.

In the preferred embodiment, the packets 62 are disposed in size order from shortest to tallest, with the shortest packet or envelope 62 at the front of the carton, and taller packets or envelopes 62 inserted in the carton behind the shortest packet. Thus, the recipe components 22 are readily visible and readily accessible to the consumer when the carton is opened.

The recipe components 22 may be inserted into the carton from the top of the carton, as depicted in FIG. 1., wherein the top flaps of the front 38 and back 40 walls are glued to each other after the recipe components are loaded into the carton. Alternatively, the top wall flaps may be glued first and the carton loaded with the recipe components from the bottom, wherein the bottom wall flaps are glued to each other after loading.

As noted above, the cover 30, when open, provides a high impact graphic display 26, by providing a large printable area on the interior of the breakaway flap 32, and by being self-supporting in open position. This permits the consumer to read or view graphics such as writing or illustrations on the interior surface of the cover 30 while the cover remains open, that is, while a meal is being prepared from the recipe components 22 of the meal kit 20. Such graphics may comprise instructions for use of the meal kit, a promotion, poetry illustrations, photographs, patterns, any combination thereof, and/or other subject matter. The cover 30 is preferably constructed such that it can remain upright and open, once opened by the consumer. Maintaining the cover in a fully open position, i.e, with the top wall 42 pivoted at least 90° from its closed position, may require the consumer to fold or bend back the cover initially through 180° or more. With the cover 30 fully opened, the consumer may view and access all contents of the meal kit throughout the preparation of the meal through the front and top openings, and may reach into the carton 28 and remove any recipe components 22, with the billboard 26 graphics being prominently displayed throughout the preparation of the meal.

The top side flaps 44 which are hingedly attached to the side walls are preferably less than about ⅙ to about ⅛ the width of the carton. This is another feature that insures that the consumer can view the contents of the carton easily, and said contents are readily accessible to the consumer.

The meal kit 20 may be used to contain various different meal components 22, particularly components that may be stored on the shelf for extended periods of time. Such meals include, but are not limited to, pizza, dry, add-meat dinner kits, protein-based food items, grain-based food items, vegetables, and vegetable-based food items, macaroni and cheese, starch-based side dishes including rice, pasta, potatoes, and breads, and the like.

In the illustrated embodiment of the invention, the front wall 38 of the carton 28 has an easy open feature 24 which permits the consumer to effectively open the meal kit. To this end, the front wall 38 of the carton 28 preferably has a button 64 defined by the third border 60 and a line of weakness 66 parallel to the third border, immediately beneath the front wall 32 portion of the cover. The button 64 is inwardly displaceable so that a consumer may, by applying pressure to the button, insert a digit beneath a lower end of the front wall portion 32 of the cover and pull the lower end outward, then progressively remove the front wall portion of the cover from the front wall to provide visual and manual access to the recipe component pouches through the front wall.

Figure 3:
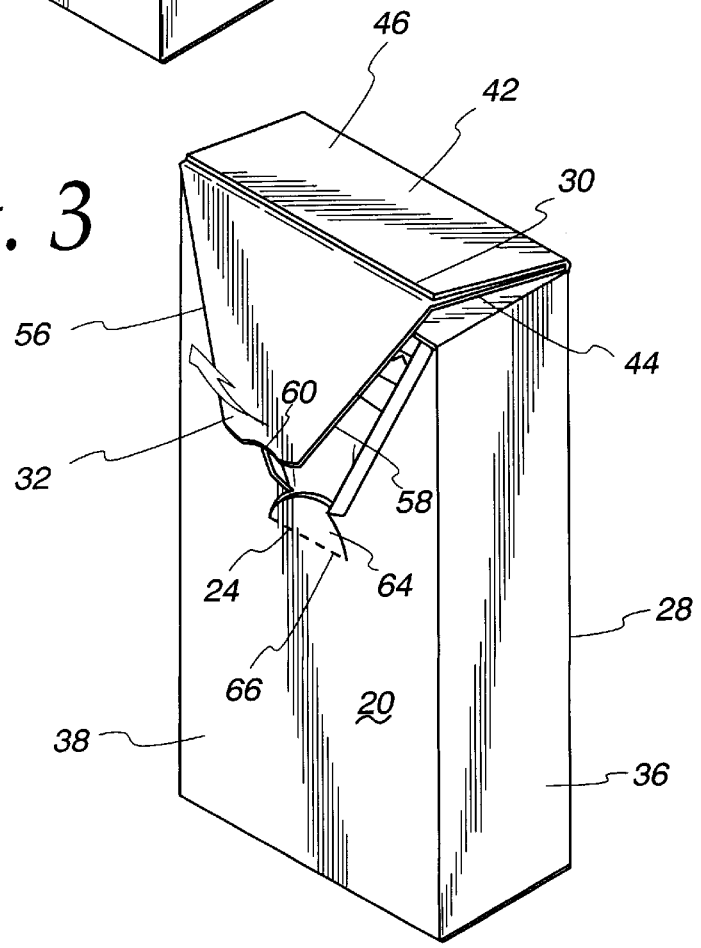
FIG. 3 is a perspective view of the meal kit of FIGURE 1, illustrating opening of the carton.
Figure 4:
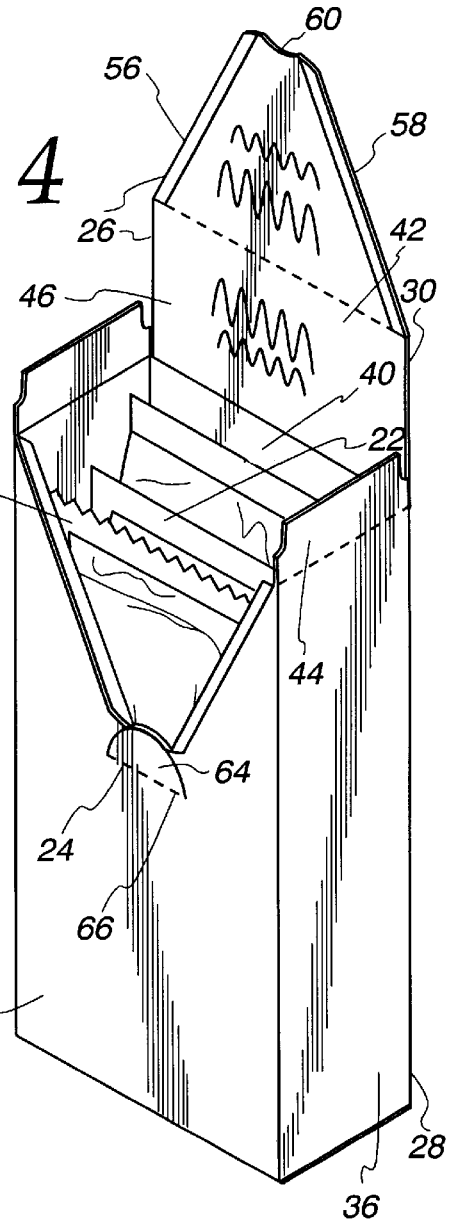
FIG. 4 is a perspective view of the meal kit after opening.
Figure 5:
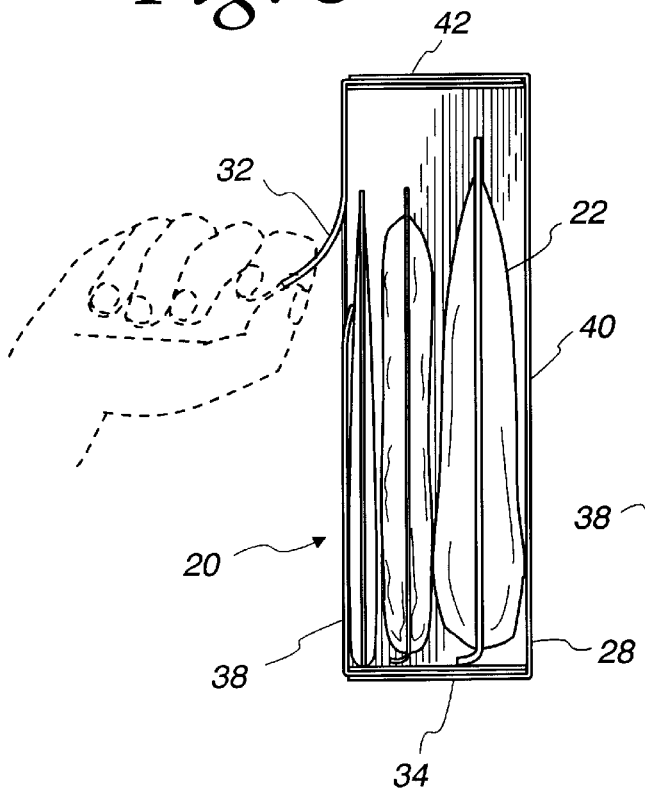
FIG. 5 is a sectional view of the meal kit being opened.

In the preferred embodiment, the top wall 42 comprises first and second top flaps of the front and back wall respectively, the first and second top flaps being joined to one another, and being integral with the front and back wall respectively, but not joined to the side walls 36. The lines of weakness preferably comprise downwardly convergent reverse cuts configured to facilitate outward displacement of the front wall portion of the cover. As shown in FIGS. 3–5, the button 64 is initially joined to adjacent portions of the front wall 38, such as the bottom of the front wall portion of the cover, by a frangible connection which may be fractured by application of pressure by a user's thumb or finger.

In the preferred embodiment, the third border 60 comprises at least part of a semicircular perforated line. The third border 60 may be any shape that defines the button 64 so that a consumer's digit may be inserted through the button to lift up the front wall portion of the cover.

The perforated portion, either the semi-circle or other shape, includes at least one connection or more between the button 64 and the rest of the front wall. One connection made be made between the button and the flap. Where there are three connections, two attach the button to the two flanking regions of the front wall that are adjacent to the front flap, and one attaches the button to the front flap. More connections may exist as well.

In a preferred embodiment, the upper edge of the button 64, preferably a semicircle, extends beyond the third border 60, which exists merely as the region of the semicircle between the first border 56 and the second border 58 of the front flap.

The bottom border of the button is defined by a line of weakness 66 or fold line. This is a region wherein the button 64 folds inward at the application of pressure by the consumer's digits. This line of weakness may be formed by a fold line, compression of the paperboard, embossing of the paperboard, a score line or perforated line, and the like. In one embodiment, the bottom border 66 of the button is defined by a perforated line and the button, when pushed inward by the consumer, completely detaches from the front wall and is punched loosely into the carton, now detached from the front wall.

We claim:

1. A meal kit comprising a disposable, stand-up, one-use carton and a plurality of recipe components in said carton, said carton defining an enclosed interior space with said recipe components disposed therein, said carton including a bottom wall, two side walls, a front wall, a top wall and a back wall, said carton further comprising a hinged cover that comprises a portion of said front wall and said top wall of said carton, an interior surface of said cover being hidden from view when said cover is closed, but exposed when said cover is open, said interior surface having printed matter thereon,, said front wall portion of said cover comprising a first, a second and a third border, said first and second borders proceeding diagonally toward one another from respective top corners of said front wall, and said third border defining an the area where said first border and said second border come in proximity to one another, said third border being approximately parallel to a top edge of said front wall, wherein said first border and said second border each comprise a first cut line, in the inner surface of the wall and a second cut line in the outer surface of the wall, the start and terminus of each of the first and second cut lines being disposed substantially at the top corners of said front wall and at either end of said third border, the first and second cut lines extending to a depth less than the thickness of the wall;

each second cut line being spaced a predetermined distance from an adjacent first cut line sufficient to form a frangible area along the top cover borders separable from the wall by the application of localized, outwardly-directed pressure.

2. A meal kit as defined in claim 1 wherein said interior surface of said cover displays illustrations or writing which are visible to the consumer only after said carton is opened.

3. A meal kit as defined in claim 1 wherein said cover is capable of supporting it self in an open position, so that the interior surface of said cover remains exposed and visible to the consumer and the contents remain easily accessible, without interference from the cover, during preparation of a meal using said recipe components.

4. A meal kit as defined in claim 1 wherein said cover, once opened, remains open so that the recipe components of said kit for preparing said meal and said interior surface of said cover remain visible to the consumer throughout the process of preparing said meal.

5. A meal kit as defined in claim 1 wherein the front wall portion of said cover has a vertical dimension greater than the depth of the carton to provide said front wall portion with a significant visual impact when said cover is in its open position.

6. A meal kit as defined in claim 1 wherein the top flaps hingedly attached to said side walls are less than about ⅙ to about ⅛ the width of said carton.

7. A meal kit comprising:

a disposable, upstanding, single use carton including a front wall and a top wall, said front wall having an upper edge adjoining said top wall and having a pair of frangible lines of weakness formed therein extending downward from said upper edge to define a flap joined to said top wall, said flap being movable between an initial, closed position and an open position in which displacement of said flap creates an opening in said front wall extending from the upper edge of said front wall to a predetermined elevation therebeneath, said flap having inner and outer surfaces, said inner surface having graphics thereon, and a plurality of upstanding meal component pouches, each meal component pouch comprising a pouch and a food item contained therein, each of said meal component pouches having an upper edge disposed at an elevation above said predetermined elevation, said flap being capable of supporting itself in said open position to provide a billboard effect for prominent display of said graphics on said inner surface, while said opening in said front wall simultaneously provides visual access to said meal component pouches through said front wall.

8. A meal kit in accordance with claim 7 wherein said carton further includes a back wall opposite said front wall, and a pair of side walls extending between said front wall and said back wall, and wherein said top wall comprises first and second top flaps of said front and back wall respectively, said first and second top flaps being joined to one another and being integral with said front and back wall respectively, but not joined to said side walls.

9. A meal kit in accordance with claim 7 wherein said lines of weakness comprise downwardly convergent rev cuts.

* * * * *